United States Patent [19]

Wallace

[11] 4,137,145

[45] Jan. 30, 1979

[54] SEPARATING WEB FOR ELECTROLYTIC APPARATUSES

[75] Inventor: Bruce S. Wallace, Grand Island, N.Y.

[73] Assignee: Hooker Chemicals & Plastics Corp., Niagara Falls, N.Y.

[21] Appl. No.: 866,447

[22] Filed: Jan. 3, 1978

[51] Int. Cl.[2] ..... C25B 1/16; C25B 1/12; C25B 9/00

[52] U.S. Cl. ..... 204/290 R; 204/254; 204/256; 204/266; 204/279

[58] Field of Search ..... 204/290 R, 252, 254, 204/256, 258, 266, 279, 129, 98

[56] References Cited

U.S. PATENT DOCUMENTS

| | | | |
|---|---|---|---|
| 3,017,338 | 1/1962 | Butler, Jr. et al. | 204/266 X |
| 3,220,941 | 11/1965 | Osborne | 204/266 X |
| 3,684,670 | 8/1972 | Raetzsch | 204/266 X |
| 3,775,272 | 11/1973 | Danna | 204/266 X |
| 3,884,781 | 5/1975 | Bouy et al. | 204/279 X |
| 3,930,151 | 12/1975 | Shibata et al. | 204/266 X |
| 4,026,782 | 5/1977 | Bouy et al. | 204/279 X |
| 4,035,255 | 7/1977 | Gritzner | 204/98 |
| 4,055,291 | 10/1977 | Peters | 204/256 X |
| 4,057,479 | 11/1977 | Campbell | 204/258 |

*Primary Examiner*—Arthur C. Prescott

*Attorney, Agent, or Firm*—Peter F. Casella; Howard M. Ellis

[57] ABSTRACT

A separating web for use in an electrolytic apparatus having a plurality of cells containing anolyte and catholyte includes a pair of thin metal walls not in contact with each other, one of which is of a material, such as titanium, which is resistant to corrosion by and impermeable to such anolyte (which may be brine in an electrolytic cell used for the manufacture of chlorine and caustic or chlorate) and the other of which is of a material resistant to corrosion by and impermeable to such catholyte, which may be steel (which, although resistant to corrosion by the caustic catholyte of a cell for the manufacture of chlorine and caustic or chlorate, may allow the transmission of nascent hydrogen). The walls are separated from each other by a gas space, which may be vented for the escape of any molecular hydrogen formed therein from nascent hydrogen and the web is sealable in the electrolytic apparatus between adjacent cells thereof so as to separate such cells.

17 Claims, 4 Drawing Figures

SEPARATING WEB FOR ELECTROLYTIC APPARATUSES

This invention relates to a separating web for use in an electrolytic apparatus. More particularly, it relates to such a web comprised of spaced apart metallic walls with a gas space between them in which nascent hydrogen may be readily converted to molecular hydrogen, thereby preventing adverse effects of the nascent hydrogen on the web.

Electrolytic apparatuses incorporating cells containing monopolar and/or bipolar electrodes are used for the manufacture of various chemical materials, including chlorine, caustic and chlorate, and are well known. It is also known to make such cells of a filter press assembly type, wherein a plurality of them is held together by longitudinally compressive forces like those applied at the ends of a filter press. In bipolar apparatuses of such type electric current is passed from an anode through the electrolyte to a cathode and then from such cathode to an adjacent anode of a bipolar electrode and such operation is repeated throughout the length of the apparatus. It is important that each cell be physically separate from the next so that electrolytic fluids in them will not be transferred between them. In recent years, rather than to employ steel and mastic as materials of construction for electrolytic cell body and wall parts, synthetic organic polymeric materials have been substituted, such as filled polypropylene.

Use of synthetic organic polymeric materials, such as polypropylene, allows the molding and extrusion of electrolyte compartment frames and other cell parts and accordingly permits the manufacture by comparatively inexpensive methods of bipolar electrolytic apparatuses, preferably of the filter press type. Also, because of the generally good resistance of polypropylene and equivalent and similar moldable polymeric materials to various types of electrolytes, such as hydrochloric acid, brine, aqueous caustic solutions and aqueous chlorine solutions, frames of such materials resist chemical attack during use. However, applicant has found that integral frames and webs possess disadvantages which are desirably corrected. With the present state of knowledge in the art it is very difficult to accurately mold larger electrolyte compartment frames which incorporate separating webs. Also, due to the different thicknesses of the materials involved it has been found that areas of strain exist where certain thin and thick component parts join and because such strains even vary between different molded articles from the same mold, modifications of mold designs do not readily solve the problem. Futhermore, also as a result of the different thicknesses of the frame and separating web materials where they join in an integral structure, during heating and cooling of an electrolytic cell the differential expansion experienced (with the thinner part being heated or cooled more rapidly than the thicker part) creates strains which, especially in larger pieces, can cause minor distortions and inefficiency of cell operation at best and warping, cracking and fractures of parts thereof, with attendant undesired reactions and leakage of electrolyte, at worst. The described objections to integrally molded large electrolyte compartment frames and separating webs have been overcome by the present invention. It permits the use of a separate separating web, which obviates molding problems due to increasing the sizes of the structures involved to produce electrolytic cells of greater capacities and at the same time eliminates strains at points of connection or joinder of the web and frames. Also, strains are not created in the described structures because of expansions of some of the parts thereof, especially differential expansions between the web and the frames upon heating and cooling of the electrolytic apparatus. U.S. patent application Ser. No. 680,611, filed Apr. 26, 1976 by Eng et al., describes a filter press cell wherein the electrolyte compartment frames have a "separator" molded integrally with them. U.S. Pat. No. 3,778,362, like Ser. No. 680,611, describes synthetic organic polymeric materials, such as polypropylene, used as a material of construction for electrolyte compartment frames. U.S. Pat. No. 4,059,216 describes metallic separators inside bipolar electrodes. Yet, none of such patents except the last addresses itself to the solving of any problem confronting the present applicant and none discloses, teaches or suggests his solutions. In another application, entitled Separating Web - Electrolytic Compartment Frames Assembly for Electrolytic Apparatuses, filed by applicant the same date as this application, a non-integral web is described which is capable of being held by pressure in liquid-tight relationship to anolyte compartment and catholyte compartment frames of a filter press type electrolytic cell, while being movable between such frames to compensate for expansions and contractions of the web and thereby prevent distortion of it and also prevent loss of liquid tight separation of the anolyte and catholyte compartments of the different cells by the web. In such web, as in the present webs, means were provided for allowing conduction of electricity from an "upstream" cathode to a "downstream" anode through the web although it was also taught that such conduction could be external of the cell instead. Both plastic and metal webs were disclosed in such application, which is hereby incorporated by reference.

In the present invention metallic webs of particular structures are provided which represent improvements over simple metallic webs. Also, such are disclosed in assembly with an anode, a cathode, an internal conductor between such electrodes and collar or sleeve fitments for preventing access of the electrolytes to the internal conductor and the web interior and for preventing passage of electrolytes through the opening for such conductor in the web.

In accordance with the present invention a separating web for use in an electrolytic apparatus having a plurality of cells containing anolyte and catholyte comprises an anolyte side wall of a material resistant to corrosion by and impermeable to such anolyte and a catholyte side wall of material resistant to corrosion by and impermeable to such catholyte, said walls being separated from each other and said web being sealable in the electrolytic apparatus between adjacent cells thereof so as to separate such cells. Preferably such separating web will be employed in electrolytic cells for the electrolysis of brine or hydrochloric acid, more preferably the former, and usually in such cells one of the web walls will be of a material which is permeable to nascent hydrogen, such as steel, spacing means will be present between the web walls to hold them in spaced relationship with respect to each other and pathways will be provided through such spacing means to permit movement of gas through the web interior and preferably out a vent or into a gas header. In other preferred embodiments of the invention a walled opening will be provided through the web which will be sealed off from contact with the anolyte and catholyte and through which an electrical connection between a cathode and an anode of adjacent cells may be effected.

The invention will be readily understood by reference to the specification, taken in conjunction with the drawing, in which.

Figure 1:
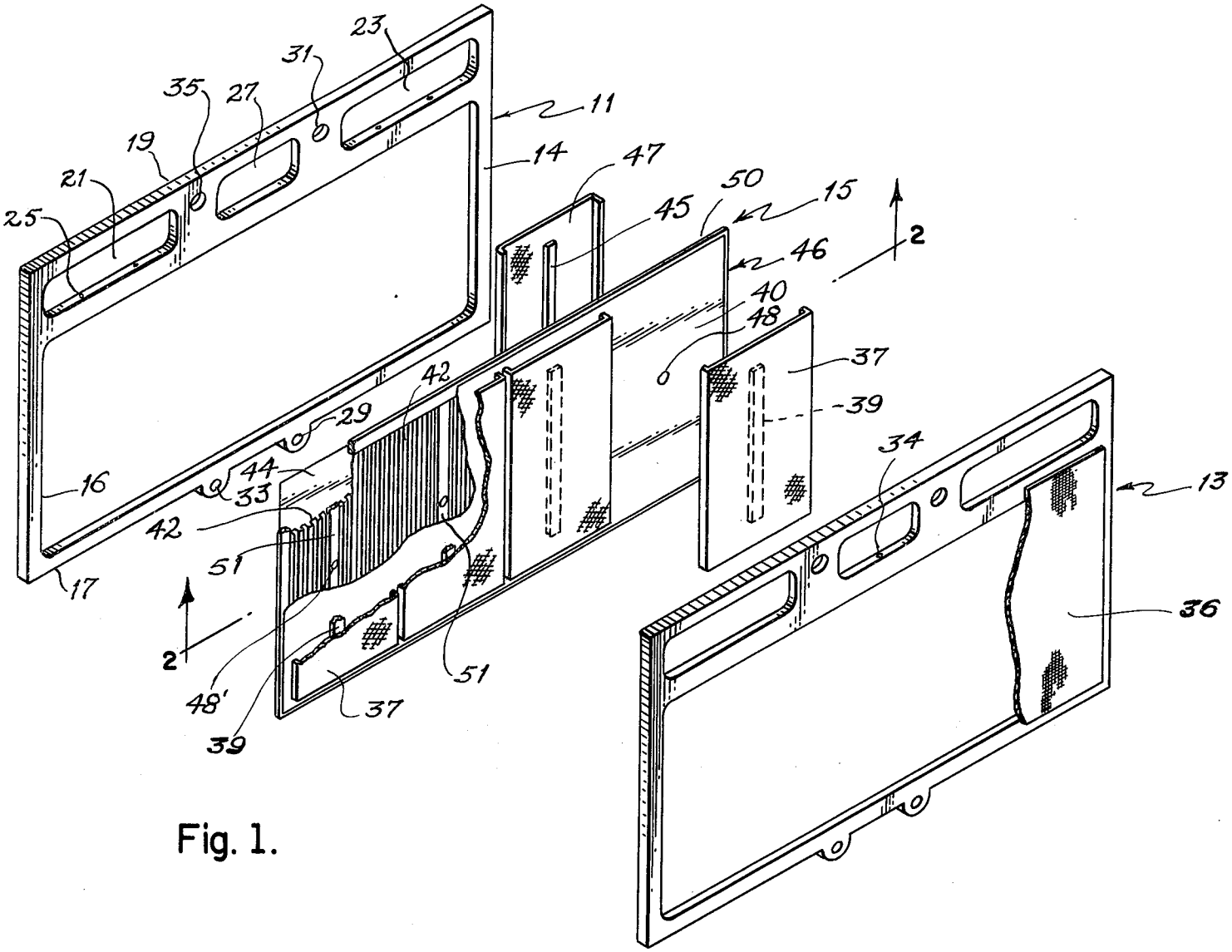
FIG. 1 is a partially disassembled view of a separating web of this invention together with a pair of electrolyte compartment frames adjacent thereto, showing various electrolytic cell parts held to the web and a frame.

In FIG. 1 anolyte compartment frame 11 and catholyte compartment frame 13 are shown, for clarity of representation, separated from intermediate web assembly 15. Anolyte compartment frame 11 includes framing walls 14 and 16, bottom framing portion 17 and top framing portion 19, all of which combine to form the generally rectangularly shaped framing structure of member 11. Internal header openings 21 and 23 are for gaseous products of electrolysis generated at the anode and such gas passes through openings 25 from the anolyte compartment section below to the headers, which are formed by the walls about such openings. Header opening 27 is for gas which may be generated at the cathode. Thus, in a cell for the electrolysis of brine, headers 21 and 23 are for chlorine and header 27 is for hydrogen. Additionally, headers 21 and 23 are for anolyte liquid and header 27 is for caustic solution. Drains 29 and 33 are for brine and caustic, respectively and inlets 31 and 35 are for brine and caustic solution feeds. Compressive forces are applied to the frames and intermediate webs, as by tightening of threaded nuts (not shown) onto threaded ends of tightening rods or bolts (not shown) so as to tightly press a series of electrolyte compartment framing members together. Catholyte compartment framing member 13, as illustrated, is clearly of a structure similar to that of anolyte compartment frame 11 and accordingly the parts thereof need not be further described except for mention of passage 34 for the removal of gas generated at the cathode from said cathode area to header pasageway or opening 27. Ion exchange membrane 36 is held to the catholyte compartment frame 13 by suitable means (not shown) but may be held to the "far" side (that away from the viewer) of the anolyte compartment frame 11 instead. It is continuous and a single and unitary membrane, such as one of fluorinated polymeric plastic of the ion exchange type, e.g., Nafion, manufactured by E. I. DuPont de Nemors & Co., Inc., covers the frame and overlies all four (or other number, e.g., 1–8) cathodes. The membrane may sometimes be replaced with a suitable semipermeable membrane or diaphragm.

Figure 2:
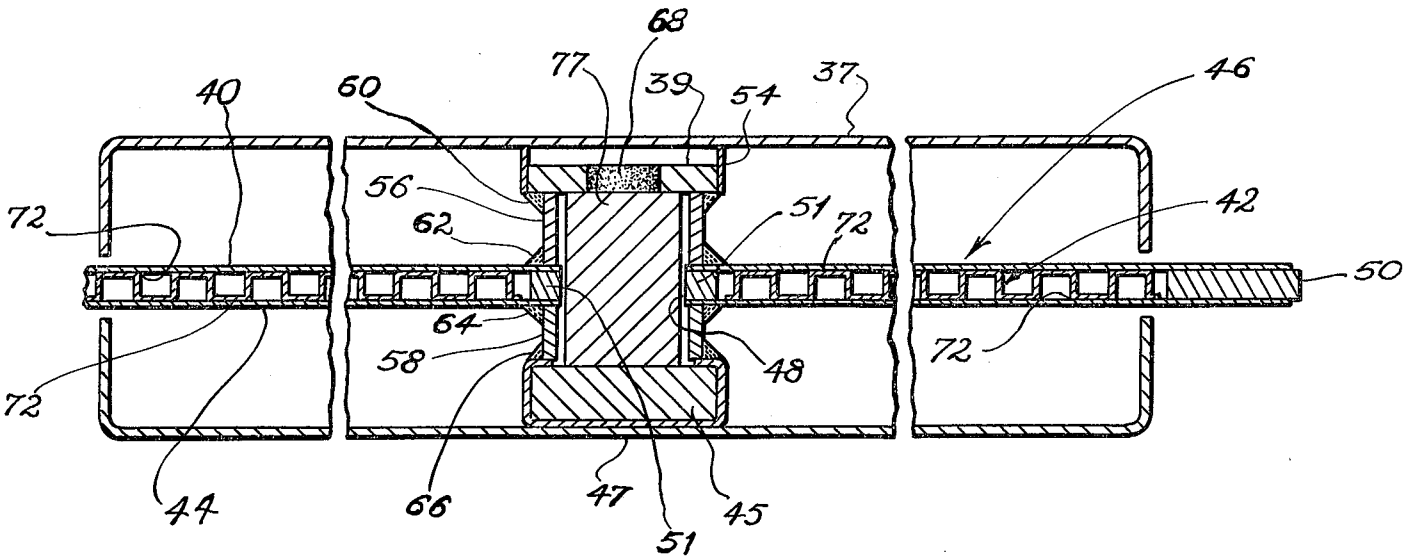
FIG. 2 is a partial horizontal sectional plan view along plane 2—2 of the farthest right portion of the separating web of FIG. 1, with electrodes and means for conducting electricity between such electrodes illustrated installed thereon.
Figure 3:
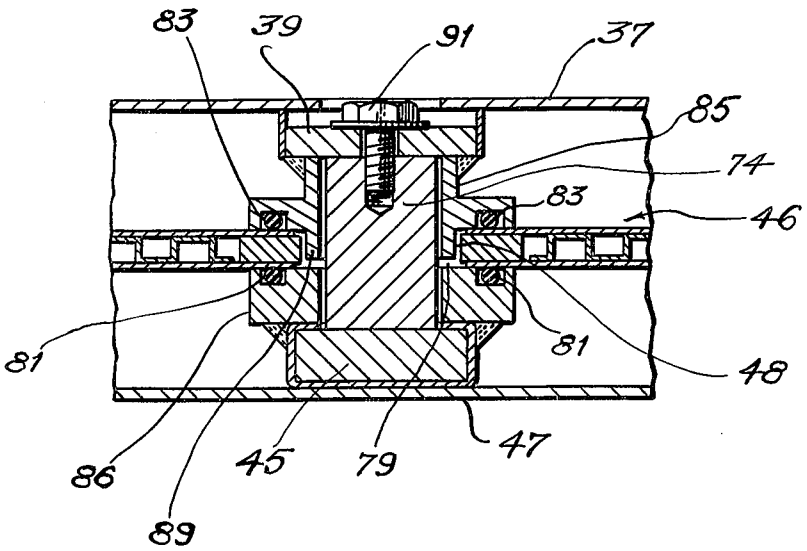
FIG. 3 is a corresponding partial horizontal sectional plan view of a separating web like that of FIG. 1 with different electrically conductive means connecting the electrodes.
Figure 4:
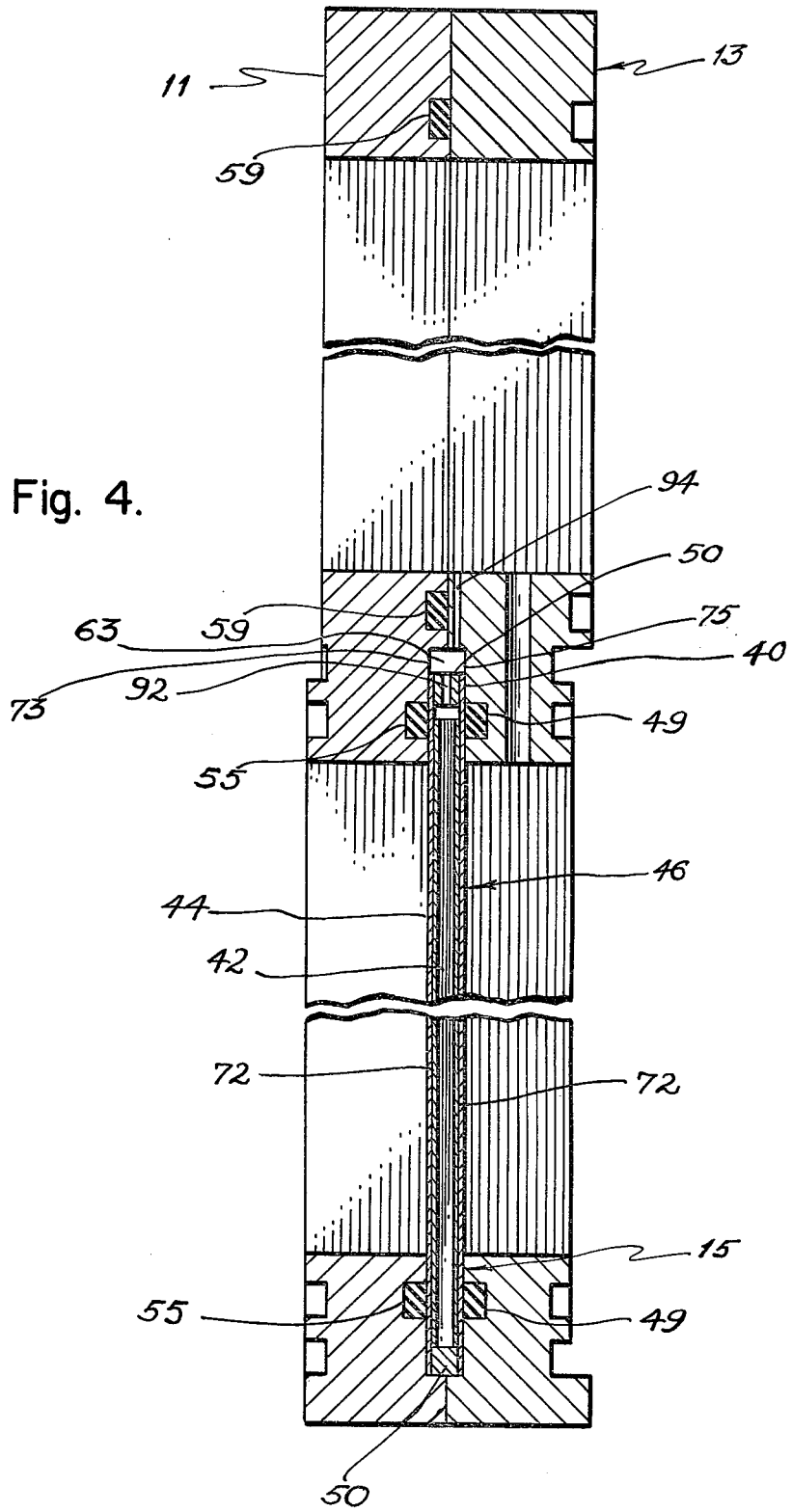
FIG. 4 is a partial vertical sectional elevation of a separating web of this invention installed between electrolyte compartment frames.

Web assembly 15 includes web 46 which is mountable in sandwiched relationship between frames 11 and 13, as is illustrated in more detail in FIG. 4. FIGS. 2 and 3 show the internal structure of web 46 and the relationship of said web to adjacent electrodes and to means for conducting electricity from one of such electrodes to the other. Web 46 includes cathode side sheet wall 40, vertically corrugated separator sheets 42 and anolyte compartment side wall 44. Around the periphery of the separating web is frame 50 and between corrugated sheets 42 and aligned with anode and cathode conductor bars, to be described later, are vertical framing separators 51. The web walls 40 and 44 are cemented to the peripheral frame 50, the separating frame members 51 and the contacting sides of the corrugated spacing means or supports 42. Opening 48' in vertical framing member 51 corresponds to opening 48 in web wall 40 and is for passage therethrough of a conductor to conduct electricity from the upstream cathode to the downstream anode, which also will be described in more detail later.

The cathode screens 37, as illustrated, being four separate screens, each fastened to a cathode conductor bar 39, are each essentially rectangular in shape with sides being formed or bent so as to extend from the major surface of the cathode screen toward the web (although such parts do not normally contact it). The tops and bottoms of such screens may be similarly formed. Cathode conductor bars 39 are joined to cathode screens 37 by suitable conductive welding or other conductive joinders and to intermediate conductive sections, not illustrated in FIG. 1 but shown in FIGS. 2 and 3, by welds, bolts or other fastening means. Anode conductor bar 45 and anode screen 47 are viewable when moved away from the web, as is passageway 48 through web 46 when cathode screen 37 and conductor bar 39 are similarly moved. Various modifications of the structure shown in FIG. 1 may be made. For example, single anode and cathode screens may be employed instead of the eight (four each) electrode screens illustrated. Different methods of joinder of the conductor bars to the electrodes may be utilized and such bars and the electrodes, frames and webs may be of other shapes, structures and designs. For example, alternatively, the conductor bars may be connected to other such bars (cathode bar to anode bar) externally, obviating the need for conduction via a conductor passing through the separator. FIG. 1 does not show and this description does not refer to all the details of the framing members and web because it is considered that most of these will be evident to those of skill in the art and relate primarily to fitting together and sealing of various cell parts and not to the primary aspects of the present invention. Thus, showing them in detail might tend to obfuscate rather than clarify the invention. Omitted parts which are relevant to the invention will be described more completely with reference to FIGS. 2–4. Thus, gasketings, ledges, recesses, bolts, collars, etc., are not shown or if shown are not always specifically mentioned.

In FIG. 2, wherein an enlarged partial view of the right quarter of the web assembly of FIG. 1 is shown, with conductive means therein, cathode 37 is welded or otherwise suitably fastened to cathode connector 54 to cathode conductor bar 39 to intermediate conductive rod or material 77 to clad anode conductor bar 45 and finally, to anode 47. This combination of electrodes and conductive elements has the intermediate conductive material 77 thereof pass through the opening 48 in web 46. Such opening contains gaps, e.g., air. Sleeves 56 and 58 are provided and are shown welded by welds 60, 62, 64 and 66 to the cathode conductor bar, the separating web catholyte side wall, the separating web anolyte side wall and the titanium clad copper anode conductor bar, respectively. As illustrated, the copper portions of anode conductor bar 45 and cathode conductor bar 39 are both fused or welded to intermediate conductive rod 77. Area 68 of the cathode conductor illustrates a section which is fusion welded to conductive rod 77.

It will be noted that in the interior of web 46 corrugated material 42 has surfaces adjacent to and in contact with the interiors of separator walls 40 and 44. Between such "contacting" portions and the wall interiors is a thin layer of cement, designated by numeral 72. Similarly, frame 50 and internal framing member 51 are also cemented in place to the web walls. Thus, there is no need for special welding of titanium or other metal wall part of the separating web to steel or other incompatible metal framing material. However, it is feasible to weld the reinforcement in place to at least one side of the separating web when the materials thereof are compatible. Of course, instead of utilizing metallic corrugated materials or other reinforcing or spacing means synthetic organic polymers and materials of other types may also be employed. Such will usually not be satisfactorily weldable (although they often may be fusible) and accordingly cementing will often be preferred.

In FIG. 3 cathode 37, suitably fastened, as by welding, to cathode conductor bar 39, has electrical current communicated from it through the conductor bar 39 and intermediate conductive material 74, which may be joined to cathode conductor bar 39 or to anode conductor bar 45, to anode 47. Although, as was the case with respect to the inter-cell conductor of FIG. 2, it is highly desirable for the conduction of the electrical current to be essentially perfect, with little or essentially no resistance, it is also important that there should be no transfer of liquid or gas from one electrolyte compartment to another. For this reason opening 48 in web 46 (which allows passage of the conductor from cathode to anode) is sealed off by ring gaskets 81 and 83, contained in accommodating recesses in collars 86 and 85, the former being joined to anode conductor bar 45. Collar 86 will be made of a material resistant to anolyte, e.g., titanium, in a cell for the electrolysis of brine, and correspondingly, collar 85 will be made of a material resistant to catholyte, e.g., steel, when to be used in a similar cell. The welds employed will, of course, be of material suitable for effecting the particular weldings, titanium to titanium in the case of the collar-anode joinder and steel and copper (from the anode connector and anode conductor bar) to the steel or copper of collar 85. It will be seen that the clearance space 79 between the collar-shaped members in passage 48 allows for tightening of the parts thereof by bolt 91 without causing strains due to movements of one part against another and yet ledge portion 89 helps to position collar 85 with respect to web 46.

In FIG. 4 the structure illustrated has been shortened, as indicated by discontinuity symbols, so as to be able to utilize a more illustrative drawing to show the web of this invention and the frames pressed against it. As is seen from the drawing, web assembly 15, shown primarily as web 46, is sandwiched between anolyte compartment frame 11 and catholyte compartment frame 13. Resilient gasket 49, which fits into a continuous accommodating recess (not numbered) in the catholyte compartment frame and "encircles" the web 46, normally projects beyond such recess but, as illustrated in the assembly of the catholyte compartment frame, web and anolyte compartment frame shown, illustrated under compressive force, it is substantially flattened and contacts the cathode side wall 40 of the separating web over substantially the entire width of the accommodating recess when in sealed, fluid-tight relationship with the frame and web. A matching gasket is provided in a similarly accommodating recess in the anolyte compartment frame 11. Thus, gasket 55 also holds the web 46 in liquid-tight and fluid-tight contact with anolyte compartment frame 11. Additionally, gasket 59, in an accommodating recess in the anolyte compartment frame, prevents escape of gaseous products of electrolysis from the gas headers. Although the various gaskets and recesses are illustrated somewhat conventionally as being generally rectangular in cross-section various other suitable shapes may also be employed so as to obtain improved sealing effects. Among the seals illustrated in FIG. 4 an important feature of the present invention is in the seals 49 and 55 preventing access of electrolyte to the ends of frame 50, thereby protecting the cement layer exposed at such ends. Also, similar protective sealing is shown by gaskets or rings 81 and 83 of FIG. 3 and welds 62 and 64 of FIG. 2. The sealing off of the upper web end by seals 49 and 55 also prevents access of electrolyte to web venting passage 92 and frame vent 94, which communicates with hydrogen header 27.

In the assemblies illustrated the electrolyte compartment frames measure approximately 1.5 by 2.7 meters, with the longest axis being horizontal but with one of the two major axes being vertical (the axis of thickness is also horizontal). For simplicity of illustration, although a recess or a pair of recesses is/are similar to that at 63 also provided at a vertical end or at such ends of the web, such a recess is illustrated in FIG. 4 at the top of the web. Recess 63 has top and side wall portions adjacent the catholyte compartment frame and the corresponding portions in the anolyte compartment frame, forming recesses in such frames. Also, walls 73 and 75 are walls of corresponding recesses in the mentioned frames to accommodate web 46. Although recess 63 is illustrated at the top of the web 46 a corresponding recess may also be and is sometimes provided adjacent the bottom of such web so as to allow expansion of the web in both directions without strain on the assembly. However, it has been found that provision of the recess or room for expansion at the top only (plus sides, as previously mentioned) is suitable for assemblies of the size and character herein described and often, due to its weight, the web will settle to the bottom.

It will be noted that the passageway through the web separator is not shown in FIG. 4 and neither is the conductive means for inter-cell conduction of electricity from the cathode of a bipolar electrode to the anode of the next. Such parts are illustrated in FIGS. 2 and 3 and either may be considered to be inserted at the bottom "break" line of FIG. 4. Also, FIG. 4 may be considered to omit such conductive means.

The anolyte compartment frames and catholyte compartment frames useful with the present invention may be of various sizes but the invention is most useful with respect to larger such frames which are difficult or impossible to make with a separating web molded therein. Generally it is very difficult or presently impossible to accomplish such molding when the overall nominal surface area (of one major surface, considered as the area of a plane generally parallel to such surface) is 1.6 square meters or more and the height and width of such frame are each at least one meter. The thickness of such frames may vary, even over the length of a single frame, but are usually in the range of 2 to 8 cm. While the materials of construction of the frames may be selected for the particular electrolytic process to be employed and for compatibility with the electrolyte and products of electrolysis, normally the synthetic organic polymeric materials, commonly referred to as plastics, will be most useful. Both thermoplastics (of sufficiently high softening points) and thermosetting plastics may be employed. For example, poly-lower alkylenes, such as polypropylene, polyethylene, polyethylene-polypropylene and poly(ethylene-propylene) are presently considered to be most preferred but in appropriate circumstances polyesters, polyethers, phenolic polymers, polyurethanes, polyacetals, those polymers generally referred to as engineering plastics, fluorinated and perfluorinated poly-lower alkylenes, polyvinyl halides, such as polyvinyl chloride and other such materials, in filled or unfilled states or as coatings over base materials may be utilized. Preferred fillers include glass fibers (preferably of lengths from 0.1 cm. to 1 cm.), chopped glass fibers, asbestos, mica, talc, silica, and various other compatible fillers known to the art, which often contribute rigidity and other desirable physical and chemical properties to the frames. The presently most preferred materials, glass fiber- and asbestos-filled plastic (polypropylenes), contain from about 10 to 50% of filler material (mixtures of fillers may also be employed) and have desirable physical properties, in addition to being chemically resistant to most electrolytes, including brine at both acidic and alkaline pH's and with chlorine dissolved therein.

The webs of the present invention may be of various types of materials but metals are preferred. The materials employed will be resistant to corrosion by and impermeable to electrolytes with which they are in contact. Thus, although various metals may be utilized for the cathode, including platinum and other noble metals, and non-metals such as graphite, many of which may be impervious to nascent hydrogen, and such materials may also be useful for the cathode side wall of the web, it is preferred to employ soft steel for the cathode and the cathode side major wall of the web, although other steels and iron can be substituted for it. Similarly, although various known corrosion resistant and impermeable materials for the anode side web walls may be employed titanium has been found to be highly preferable. The corrugated or otherwise reinforced and reinforcing spacing means may be any suitable such means, including polyurethane foams, preferably open celled, polycarbonates, polystyrene foams, polyethylene, polypropylene, polyvinyl chloride, nylon, polyacetals, engineering plastics or other suitable synthetic organic polymeric materials and wood, but steel and aluminum are most preferred. Such materials are also useful for the framing members at the ends of the web and for the collars or materials of construction of the intermediate reinforcing frames which close off access to the web interior at the web openings (for the passage of conductors). Normally the titanium and steel sheets of the web walls will be from 0.7 mm. to 7 mm. thick, preferably from 1 to 2 mm. thick and the total thickness of the web will be from 0.6 cm. to 2.5 cm., preferably 0.8 to 1.5 cm., with the thickness of the corrugated material being from 0.1 mm. to 3 mm., preferably being 0.2 mm. to 1 mm. The corrugations may be squared, as shown, or rounded, with "wave" lengths of about 0.5 to 10 cm. They may also be of various other shapes and in one embodiment are discontinuous. That is, although the corrugations are continuous horizontally, vertically they are separated about every 5 to 10 cm. so that the corrugating openings have different longitudinal axes. Such construction facilitates upward gas movement.

One of the very important advantages of the webs of the present invention is in the complete absence of any intimate surface contact between the web walls. Although steel may be permeable to nascent hydrogen and such hydrogen may be capable of adversely affecting a titanium wall in intimate contact with the steel wall, even when such contact is only over a small contact area, due to development of gaseous hydrogen in the interface causing separation of the two walls and also due to titanium embrittlement by the nascent hydrogen, in the web of the present invention this is prevented. Thus, when nascent hydrogen passes through a steel wall of the present web it can be combined to form molecular or gaseous hydrogen without causing distortions, blisterings and structural weakenings. This is so because in the present structures the intimate contact between the web walls is not needed for conductivity or structural integrity of the web and is not present. When adhesive is employed any hydrogen generated at the interface of such adhesive and the steel can escape readily. Similarly, nascent hydrogen does not adversely affect the web and the assembly at the inter-electrode conductor means.

In the webs illustrated, wherein the cathode side walls are thin and of soft steel, it is possible for nascent hydrogen to penetrate to the web interior. In such cases there may be provided venting means communicating such interior with the atmosphere, preferably through peripheral frame member 50, as illustrated, or the interior of the web may be connected with hydrogen header 27 via passageway 34. The details of such a connection are not described further here but they will be evident to one of skill in the art.

Normally the web will be flat or in sheet form (although various other shapes may also be employed). In accordance with this invention it is preferably of a large area, usually being of 1.5 to 10 square meters, preferably 2 to 5 square meters (nominal, considering one major surface only) and is of a thickness of 0.5 to 2.5 cm., preferably 1 to 2 cm., with a height of 1 to 4 meters, preferably 1 to 2 meters and a width of 1 to 4 meters, preferably 2 to 3 meters. Of course, it fits in and is accommodated by the electrolyte compartment frames, previously described. The web is preferably located in recesses of equal depths in both the anolyte compartment frame and the catholyte compartment frame but the recess may be in one or the other, providing that the gasketing or sealing effects obtained are satisfactory. The clearance or recess for longitudinal (either vertical or horizontal) expansion of the web should be sufficient to accommodate the differential expansion obtained. Thus, recesses of 0.5 to 5 cm. total are useful, normally being 0.5 to 2 cm. total for vertical expansion and 1 to 5 cm. for horizontal expansion. Preferably, for horizontal expansion, the recesses are in the electrolyte compartment frames adjacent the vertical ends of the web and are equal at both such ends.

The adhesive, cement or glue which is preferably employed to join the web walls to framing members and to the strengthening and spacing corrugated interior (or other interior spacing material) may be of any suitable type but one which has been found to be quite satisfactory is that sold under the tradename IsoTac ®, manufactured by 3 M Company. IsoTac is an acrylic adhesive but adhesives of other types are also very useful, including liquid epoxies, nitrilephenolics, polyisobutylenes, silicone rubbers, polyurethanes, nitrile-butadiene rubbers, vinyls, natural rubbers, cyanoacrylates, polyvinyl acetates, caseinates, animal glues, hot melt formulations based on EVA copolymers, polyesters, polyamides (nylons) and SBR. Additionally, solvent fusion and heat sealing of thermoplastic materials are also useful. The adhesive may be applied as a layer to the interior surfaces of the web walls, in which case the thickness thereof may be from 0.02 to 1 mm., preferably 0.05 to 0.5 mm. However, spot cementing, gluing or adhesive application may also be employed.

The gasketing materials used are preferably elastomeric synthetic organic polymers but various other suitable substances may also be employed. Thus, at present the preferred gasketing material is EPDM but neoprene, silicone rubbers, polyurethanes and various othe types of known gasketing elastomers and other materials may also be utilized. Generally these are in continuous "ring" or other suitable pre-shaped form to be accommodated by the appropriate recesses in the apparatus parts but it is also possible to utiize straight lengths of gasketing material and to have them inserted, preferably overlapping or of matching shapes at the ends thereof, in appropriate grooves or recesses in the various apparatus parts.

The electrode conductors are chosen of suitable electrolyte-resistant materials which are satisfactorily electrically conductive. Thus, the cathode conductor bar may be of copper suitably joined to the normally steel cathode screen, as by welding. The anode conductor bar is preferably of titanium covered or clad copper. Such materials are considered to be best for utilization in apparatuses for the electrolysis of brine but other known conductive materials may be substituted for uses in other cells, as will be known in the art. The intermediate conductive material between such conductor bars and any bolting or other holding materials present will preferably be copper, which may be titanium-covered or clad on its external cylindrical surface. The collars about such conductor, which are employed to assist in sealing off the opening in the web for passage of the conductor, may be of any suitable material, including plastics, in particular circumstances, but are preferably titanium on the anode side and soft steel on the cathode side. The tightening bolt, if employed, will preferably be beryllium copper or stainless steel.

While various anodes and cathodes may be utilized it is preferred to employ dimensionally stable anodes, most preferably ruthenium oxide or other suitable noble metal or noble metal oxide on titanium or other suitable valve metal, e.g., tantalum, and to utilize steel for the cathode. Preferably, both electrodes will be in mesh form but they also may be continuous, perforated and of other types. Ion exchanging or semi-permeable membranes or diaphragams may be used near the cathode to prevent caustic produced from migrating through the electrolyte and reacting with chlorine and preferably such will be an ion exchange membrane and will be of a perfluorinated polymeric material, such as a polytetrafluoroethylene derivative, e.g., that sold by E. I. DuPont de Nemours and Company, Inc., under the trade name Nafion.

The described invention results in separating web-electrolyte compartment frames assemblies which are liquid-tight and are preferably liquid-tight and gas-tight, too. Because of the non-integral construction of the web and the frames and because of the allowance for expansion of the web into the described recess in the presence of tightly fitting gasketing materials, differential expansion on heating and cooling of the electrolytic apparatus does not result in excessive strains which could distort or destroy the assembly. The thin, substantially flat web is easily and comparatively cheaply manufactured and may be left in the installation for long periods of time, not requiring frequent replacements as a result of blistering and titanium hydride formation due to the presence of nascent hydrogen adjacent the titanium web wall.

The apparatus illustrated in the accompanying figures, with titanium and steel web walls and with either of the internal connectors shown in FIGS. 2 and 3 being employed to transmit electricity between electrode pairs thereof is presently being manufactured and will soon be tested. However, at present it is known that the structure disclosed will prevent the blistering and hydride formation associated with nascent hydrogen in contact with steel-titanium and therefore it has been established that the present invention represents a substantial improvement over prior art electrolytic apparatuses of this general type.

It is expected that a two-cell unit equipped with steel cathodes and dimensionally stable anodes will soon be ready for operation over a period of several months, utilizing a 25% brine solution to generate chlorine, hydrogen and cell liquor containing 200 grams per liter of sodium hydroxide, with the ion exchange membrane employed being DuPont Nafion. Based on testing of a similar apparatus it is expected that the unit will operate at an efficiency of 75 to 80% at 8,000 amperes and 8 volts. Conduction of electricity from an "upstream" cathode to a "downstream" cathode will be with a minimal voltage drop and the neoprene and EPDM elastomer gasketing utilized will satisfactorily maintain sealing contact with the asbestos-filled polypropylene frames and the bimetallic webs of this invention. Frequent replacements of the webs will not be necessary because of their resistance to nascent hydrogen and electrolyte and because there is no undue straining of the web by differential expansions and contractions with respect to the frames, caused by temperature changes. Also, when the conduction of electricity is over the electrolyte frames and web instead of through the web similar cell operating characteristics are expected to result. In constructing the present cells the web assemblies may be pre-assembled and installed between the frames, one of which may have a suitable ion exchange membrane pre-assembled with it.

In this specification and in the claims all the parts are by weight and all temperatures are in ° C. unless otherwise indicated.

The invention has been described with respect to various illustrations and embodiments thereof but is not to be limited to these because it is evident that one of skill in the art with the present specification before him will be able to utilize substitutes and equivalents without departing from the spirit of the invention.

What is claimed is:

1. A separating web for use in an electrolytic apparatus having a plurality of cells containing anolyte and catholyte which comprises an anolyte side wall of a material resistant to corrosion by and impermeable to such anolyte and a catholyte side wall of material resistant to corrosion by and impermeable to such catholyte, said walls being separated from each other and said web being sealable in the electrolytic apparatus between adjacent cells thereof so as to separate such cells.

2. A separating web according to claim 1 wherein the catholyte side wall of the web is of a material which is permeable to nascent hydrogen and the walls of the web are separated from each other so as to provide a volume between them for occupancy by molecular hydrogen producible by combining of nascent hydrogen atoms.

3. A separating web according to claim 2, in the interior of which, between the anolyte side wall and the catholyte side wall, spacing means are present to hold such walls in spaced relationship with respect to each other.

4. A separating web according to claim 3 which includes pathways therein between portions of the spacing means to allow upward movement of gas through the web interior.

5. A separating web according to claim 4 wherein the spacing means are cemented to the interiors of the catholyte side wall and anolyte side wall.

6. A separating web according to claim 5 wherein the anolyte side wall is of titanium and the catholyte side wall is of steel.

7. A separating web according to claim 6 wherein the spacing means is a corrugated steel sheet cemented to the interior of the web walls.

8. A separating web according to claim 7 which comprises an internally positioned peripheral frame cemented to the web wall interiors.

9. A separating web according to claim 1 which includes a walled opening through the web sealed off from access to the anolyte and catholyte, through which an electrical connection between a cathode and an anode of adjacent electrolytic cells may be effected.

10. A separating web according to claim 9 wherein a steel cathode is welded to a steel cathode connector, which is welded to a copper cathode conductor bar which is welded to a copper conductor which is welded to a copper portion of a titanium clad copper anode conductor bar which is welded to a dimensionally stable anode, said assembly being located so that the cathode, cathode connector and cathode conductor bar are on the catholyte side of the web, the anode and anode conductor bar are on the anolyte side of the web and the copper conductor passes through the walled opening in the web, with a steel collar being located about the conductor and between the steel wall of the separating web and the copper cathode conductor bar and being welded to such wall and such bar to prevent access of catholyte to the conductor and with a titanium collar being located about the conductor between the separating web and the anode conductor bar and being welded to such web and bar to prevent access of anolyte to the conductor.

11. A separating web according to claim 9 wherein the walled opening through the web is sealed off to prevent electrolyte movement to the interior of such opening and through the web by relatively movable bolt actuated sealing means comprising a pair of collars in and about the walled opening in the web and sealable to the web, an anode conductor bar and a cathode conductor bar, each of which is welded to one of the sealing collars, a conductor passing through the walled opening in the web and welded or similarly permanently joined to one of the conductor bars and bolt means for moving the other of said conductor bars and the collar welded thereto with respect to the other conductor bar so as to seal the web between the collars.

12. A separating web according to claim 8 which includes a walled opening through the web sealed off from access to the anolyte and catholyte, through which an electrical connection between a cathode and an anode of adjacent electrolytic cells may be effected.

13. A separating web according to claim 12 wherein a steel cathode is welded to a steel cathode connector, which is welded to a copper cathode conductor bar which is welded to a copper conductor which is welded to a copper portion of a titanium clad copper anode conductor bar which is welded to a dimensionally stable anode, said assembly being located so that the cathode, cathode connector and cathode conductor bar are on the catholyte side of the web, the anode and anode conductor bar are on the anolyte side of the web and the copper conductor passes through the walled opening in the web, with a steel collar being located about the conductor and between the steel wall of the separating web and the copper cathode conductor bar and being welded to such wall and such bar to prevent access of catholyte to the conductor and with a titanium collar being located about the conductor between the separating web and the anode conductor bar and being welded to such web and bar to prevent access of anolyte to the conductor.

14. A separating web according to claim 12 wherein the walled opening through the web is sealed off to prevent electrolyte movement to the interior of such opening and through the web by relatively movable bolt actuated sealing means comprising a pair of collars in and about the walled opening in the web and sealable to the web, an anode conductor bar and a cathode conductor bar, each of which is welded to one of the sealing collars, a conductor passing through the walled opening in the web and welded or similarly permanently joined to one of the conductor bars and bolt means for moving the other of said conductor bars and the collar welded thereto with respect to the other conductor bar so as to seal the web between the collars.

15. A separating web according to claim 1 wherein a vent is provided to vent any nascent hydrogen or other gaseous material from the web interior.

16. A separating web according to claim 8 wherein a vent is provided to vent any nascent hydrogen or other gaseous material from the web interior.

17. A separating web according to claim 9 wherein a vent is provided to vent any nascent hydrogen or other gaseous material from the web interior.

* * * * *